US009749762B2

(12) United States Patent
Christian et al.

(10) Patent No.: US 9,749,762 B2
(45) Date of Patent: Aug. 29, 2017

(54) FACILITATING INFERENTIAL SOUND RECOGNITION BASED ON PATTERNS OF SOUND PRIMITIVES

(71) Applicant: OtoSense Inc., Cambridge, MA (US)

(72) Inventors: Sebastien J. V. Christian, Mountain View, CA (US); Thor C. Whalen, Menlo Park, CA (US)

(73) Assignee: OtoSense, Inc., Cambridge, MA (US)

( * ) Notice: Subject to any disclaimer, the term of this patent is extended or adjusted under 35 U.S.C. 154(b) by 0 days.

(21) Appl. No.: 15/209,251

(22) Filed: Jul. 13, 2016

(65) Prior Publication Data

US 2016/0330557 A1 Nov. 10, 2016

Related U.S. Application Data

(63) Continuation-in-part of application No. 14/616,627, filed on Feb. 6, 2015.

(60) Provisional application No. 61/936,706, filed on Feb. 6, 2014, provisional application No. 62/387,126, filed on Dec. 23, 2015.

(51) Int. Cl.

| | |
|---|---|
| ***H04R 29/00*** | (2006.01) |
| ***G10L 25/27*** | (2013.01) |
| ***G08B 21/18*** | (2006.01) |
| ***G08B 17/10*** | (2006.01) |
| ***G10L 21/14*** | (2013.01) |
| ***G08B 21/04*** | (2006.01) |

(52) U.S. Cl.

CPC ..... *H04R 29/00* (2013.01); *G08B 17/10* (2013.01); *G08B 21/0423* (2013.01); *G08B 21/18* (2013.01); *G08B 21/182* (2013.01); *G10L 21/14* (2013.01); *G10L 25/27* (2013.01); *G10H 2210/301* (2013.01)

(58) Field of Classification Search

CPC .... H04R 29/00; G08B 17/10; G08B 21/0423; G08B 21/18; G08B 21/182; G10L 21/14; G10L 25/27; G10H 2210/301

See application file for complete search history.

(56) References Cited

U.S. PATENT DOCUMENTS

| | | | |
|---|---|---|---|
| 5,918,223 | A | 6/1999 | Blum |
| 7,991,206 | B1 | 8/2011 | Kaminski, Jr. |

(Continued)

OTHER PUBLICATIONS

Chang et al.; "LIBSVM: A Library for Support Vector Machines", created in 2001, Last updated: Mar. 4, 2013, maintained at http://www.csie.ntu.tw/~cjlin/papers/libsvm.pdf.

(Continued)

*Primary Examiner* — Andrew L Sniezek

(74) *Attorney, Agent, or Firm* — Park, Vaughan, Fleming & Dowler LLP

(57) ABSTRACT

The disclosed embodiments provide a system that performs a sound-recognition operation. During operation, the system recognizes a sequence of sound primitives in an audio stream, wherein a sound primitive is associated with a semantic label comprising one or more words that describe a sound characterized by the sound primitive. Next, the system feeds the sequence of sound primitives into a finite-state automaton that recognizes events associated with sequences of sound primitives. Finally, the system feeds the recognized events into an output system that generates an output associated with the recognized events to be displayed to a user.

18 Claims, 10 Drawing Sheets

(56) References Cited

U.S. PATENT DOCUMENTS

| | | | | |
|---|---|---|---|---|
| 8,082,279 | B2 | 12/2011 | Weare | |
| 8,463,000 | B1 | 6/2013 | Kaminski, Jr. | |
| 8,706,276 | B2 | 4/2014 | Ellis | |
| 8,838,260 | B2 | 9/2014 | Pachet | |
| 9,215,539 | B2 | 12/2015 | Kim | |
| 2002/0023020 | A1 | 2/2002 | Kenyon | |
| 2002/0037083 | A1 | 3/2002 | Weare | |
| 2002/0164070 | A1 | 11/2002 | Kuhner et al. | |
| 2003/0045954 | A1 | 3/2003 | Weare | |
| 2003/0086341 | A1 | 5/2003 | Wells | |
| 2005/0091275 | A1 | 4/2005 | Burges | |
| 2005/0102135 | A1* | 5/2005 | Goronzy | G10L 15/00 704/213 |
| 2007/0276733 | A1 | 11/2007 | Geshwind | |
| 2008/0001780 | A1 | 1/2008 | Ohno | |
| 2010/0114576 | A1 | 5/2010 | Sundararajan | |
| 2010/0271905 | A1 | 10/2010 | Khan et al. | |
| 2012/0066242 | A1 | 3/2012 | Sathya | |
| 2012/0143610 | A1 | 6/2012 | Wang et al. | |
| 2012/0224706 | A1 | 9/2012 | Hwang et al. | |
| 2012/0232683 | A1 | 9/2012 | Master | |
| 2013/0065641 | A1* | 3/2013 | Gross | G08C 17/00 455/556.2 |
| 2013/0222133 | A1* | 8/2013 | Schultz | G08G 1/205 340/539.13 |
| 2013/0345843 | A1 | 12/2013 | Young | |
| 2016/0022086 | A1 | 1/2016 | Yuan | |

OTHER PUBLICATIONS

SHAZAM; http://www.shazam.com/apps; accessed Apr. 5, 2017.
International Search Report and Written Opinion for Application No. PCT/US2015/014927, May 18, 2015.

* cited by examiner

FACILITATING INFERENTIAL SOUND RECOGNITION BASED ON PATTERNS OF SOUND PRIMITIVES

CROSS-REFERENCE TO RELATED APPLICATIONS

This application is a continuation-in-part of, and hereby claims priority under 35 U.S.C. §120 to, pending U.S. patent application Ser. No. 14/616,627, entitled "Systems and Methods for Identifying a Sound Event," by inventor Sebastien J. V. Christian, filed 6 Feb. 2015. U.S. patent application Ser. No. 14/616,627 itself claims priority under 35 U.S.C. §119 to U.S. Provisional Application No. 61/936,706, entitled "Sound Source Identification System," by inventor Sebastien J. V. Christian, filed 6 Feb. 2014. This application also claims priority under 35 U.S.C. §119 to U.S. Provisional Application No. 62/387,126, entitled "Systems and Methods for Identifying a Sound Event Using Perceived Patterns," by inventor Sebastien J. V. Christian, filed 23 Dec. 2015. The above-listed applications are all hereby incorporated by reference.

BACKGROUND

Field

The disclosed embodiments generally relate to the design of automated systems for recognizing sounds. More specifically, the disclosed embodiments relate to the design of an automated system that uses an inferential technique to recognize non-speech sounds based on patterns of sound primitives.

Related Art

Recent advances in computing technology are making it possible for computer systems to automatically recognize sounds, such as the sound of a gunshot, or the sound of a baby crying. This has led to the development of automated systems for detecting corresponding events, such as gunshot-detection systems and baby-monitoring systems. However, these existing systems are presently unable to detect higher-level events that are associated with collections of related sounds. For example, the sound of a baby crying followed by the sound of a human voice and then silence might indicate that a person has taken care of a crying baby. Detecting such higher-level events is a complicated task because the related sounds might occur in different sequences or at the same time.

Hence, what is needed is a system for detecting higher-level events that are associated with patterns of related sounds.

SUMMARY

The disclosed embodiments provide a system that performs a sound-recognition operation. During operation, the system recognizes a sequence of sound primitives in an audio stream, wherein a sound primitive is associated with a semantic label comprising one or more words that describe a sound characterized by the sound primitive. Next, the system feeds the sequence of sound primitives into a finite-state automaton that recognizes events associated with sequences of sound primitives. Finally, the system feeds the recognized events into an output system that generates an output associated with the recognized events to be displayed to a user.

In some embodiments, the finite-state automaton is a non-deterministic finite-state automaton that can exist in multiple states at the same time, wherein the non-deterministic finite-state automaton maintains a probability value for each of the multiple states that the finite-state automaton can exist in.

In some embodiments, feeding the sequence of sound primitives into the finite-state automaton involves: (1) feeding the sequence of sound primitives into a first-level finite-state automaton that recognizes first-level events from the sequence of sound primitives to generate a sequence of first-level events; (2) feeding the sequence of first-level events into a second-level finite-state automaton that recognizes second-level events from the sequence of first-level events to generate a sequence of second-level events; and (3) repeating the process for zero or more additional levels of finite-state automata to generate the recognized events.

In some embodiments, if a probability value for a state in the non-deterministic finite-state automaton does not meet an activation-potential-related threshold value after a state-transition operation, the probability value for the state is set to zero.

In some embodiments, the finite-state automaton performs state-transition operations by performing computations involving one or more sequence matrices containing coefficients that define state transitions.

In some embodiments, recognizing a sequence of sound primitives in an audio stream comprises first performing a feature-detection operation on a sequence of sound samples from the audio stream to detect a set of sound features. Each of these sound features comprises a measurable characteristic for a time window of consecutive sound samples, and detecting each sound feature involves generating a coefficient indicating a likelihood that the sound feature is present in the time window. Next, the system creates a set of feature vectors from coefficients generated by the feature-detection operation, wherein each feature vector comprises a set of coefficients for sound features in the set of sound features. Finally, the system identifies the sequence of sound primitives from the sequence of feature vectors.

In some embodiments, the output system triggers an alert when a probability that a tracked event is occurring exceeds a threshold value.

The disclosed embodiments also provide a system that generates a set of sound primitives through an unsupervised learning process. During this process, the system performs a feature-detection operation on a sequence of sound samples to detect a set of sound features. Next, the system creates a set of feature vectors from coefficients generated by the feature-detection operation, wherein each feature vector comprises a set of coefficients for sound features in the set of sound features. The system then performs a clustering operation on the set of feature vectors to produce a set of feature clusters, wherein each feature cluster comprises a set of feature vectors that are proximate to each other in a vector space that contains the set of feature vectors. Next, the system defines the set of sound primitives, wherein each sound primitive is defined to be associated with a feature cluster in the set of feature clusters. Finally, the system associates semantic labels with the sound primitives, wherein a semantic label for a sound primitive comprises one or more words that describe a sound characterized by the sound primitive.

In some embodiments, while associating a semantic label with a sound primitive, the system performs the following operations. If semantic labels already exist for feature vectors in a feature cluster for the sound primitive, the system examines the semantic labels to determine a dominant semantic label for the feature cluster. On the other hand, if semantic labels do not exist for the feature vectors in the feature cluster, the system queries one or more users to obtain semantic labels for sounds associated with feature vectors in the feature cluster to determine the dominant semantic label for the feature cluster. Finally, the system associates the dominant semantic label with the sound primitive.

In some embodiments, a sound feature includes one or more of the following: (1) an average value for a parameter of a sound signal over a time window of consecutive sound samples; (2) a spectral-content-related parameter for a sound signal over the time window of consecutive time samples; and (3) a shape-related metric for a sound signal over the time window of consecutive sound samples.

DETAILED DESCRIPTION

Figure 1:
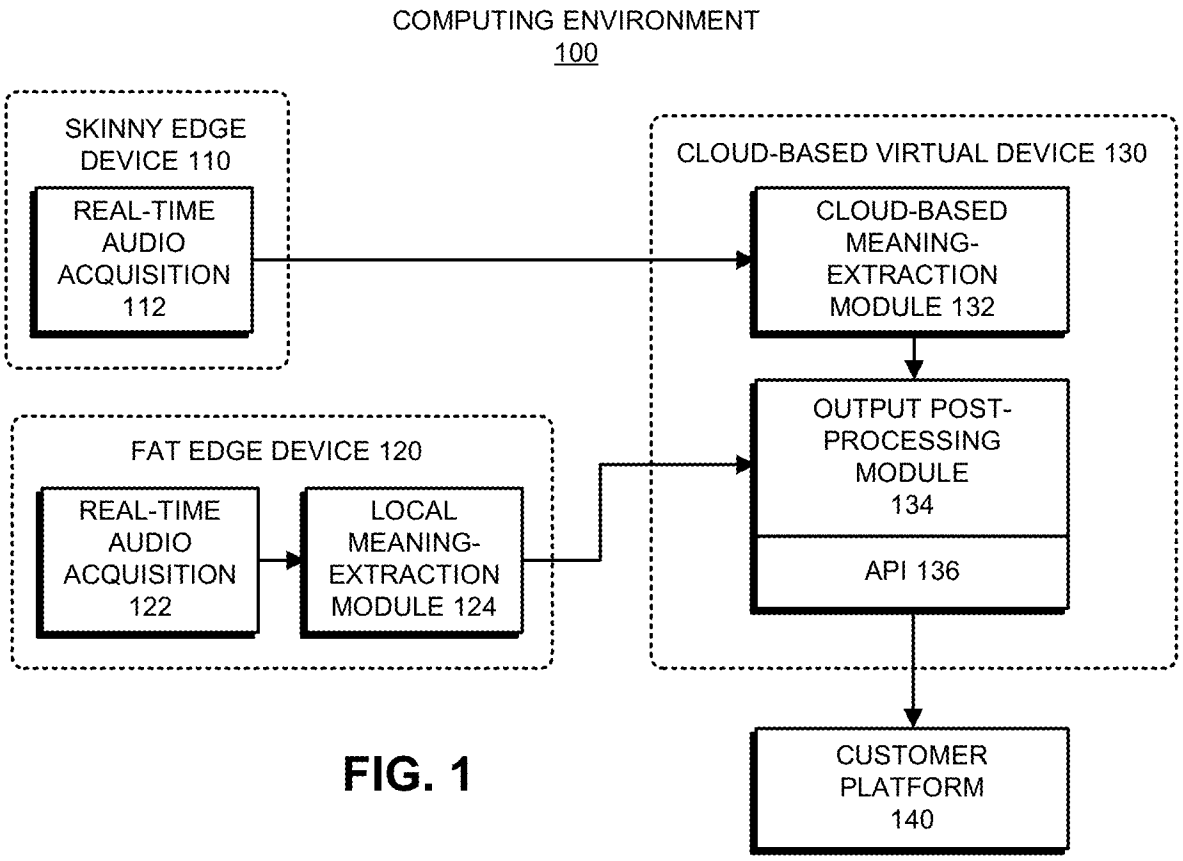
FIG. 1 illustrates a computing environment in accordance with the disclosed embodiments.

The following description is presented to enable any person skilled in the art to make and use the present embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present embodiments. Thus, the present embodiments are not limited to the embodiments shown, but are to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing computer-readable media now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium. Furthermore, the methods and processes described below can be included in hardware modules. For example, the hardware modules can include, but are not limited to, application-specific integrated circuit (ASIC) chips, field-programmable gate arrays (FPGAs), and other programmable-logic devices now known or later developed. When the hardware modules are activated, the hardware modules perform the methods and processes included within the hardware modules.

Overview

The objective of sound-recognition systems is to provide humans with relevant information extracted from sounds. People recognize sounds as belonging to specific categories, such as sounds associated with a car, sounds associated with a baby crying, or sounds associated with shattering glass. However, a car can produce a wide variety of sounds that a person can recognize as falling into the car category. This is because a person typically has experienced sounds related to cars for many years, and all of these sounds have been incorporated into a semantic category associated with the concept of a car.

At present, a sound category such as "car" does not make sense to a computer system. This is because a category for the concept of "car" is not actually a category associated with lower-level sound characteristics, but is in fact a "semantic category" that is associated with the activity of operating a car. In this example, the sound-recognition process is actually the process of identifying an "activity" associated with one or more sounds.

When a computer system processes an audio signal, the computer system can group similar sounds into categories based on patterns contained in the audio signal, such as patterns related to frequencies and amplitudes of various components of the audio signal. Note that such sound categories may not make sense to people. However, the computer system can easily categorize such sound categories, which we refer to as "sound primitives." (Note that the term "sound primitive" can refer to both machine-generated sound categories, and human-defined categories matching machine-generated sound categories.) We refer to the discrepancy between human-recognized sound categories and machine-recognized sound categories as the "human-machine semantic gap."

We now describe a system that monitors an audio stream to recognize sound-related activities based on patterns of sound primitives contained in the audio stream. Note that these patterns of sound primitives can include sequences of sound primitives and also overlapping sound primitives.

Computing Environment

FIG. 1 illustrates a computing environment 100 in accordance with the disclosed embodiments. Computing environment 100 includes two types of devices that can acquire sound, including a skinny edge device 110, such as a live-streaming camera, and a fat edge device 120, such as a smartphone or a tablet. Skinny edge device 100 includes a real-time audio acquisition unit 112, which can acquire and digitize an audio signal. However, skinny edge device 110 provides only limited computing power, so the audio signals are pushed to a cloud-based meaning-extraction module 132 inside a cloud-based virtual device 130 to perform meaning-extraction operations. Note that cloud-based virtual device 130 comprises a set of software resources that can be hosted on a remote enterprise-computing system, such as the Amazon Web Services™ (AWS) system.

Fat edge device 130 also includes a real-time audio acquisition unit 122, which can acquire and digitize an audio signal. However, in contrast to skinny edge device 110, fat edge device 120 possesses more internal computing power, so the audio signals can be processed locally in a local meaning-extraction module 124.

The output from both local meaning-extraction module 124 and cloud-based meaning-extraction module 132 feeds into an output post-processing module 134, which is also located inside cloud-based virtual device 130. This output post-processing module 134 provides an Application-Programming Interface (API) 136, which can be used to communicate results produced by the sound-recognition process to a customer platform 140.

Figure 2:
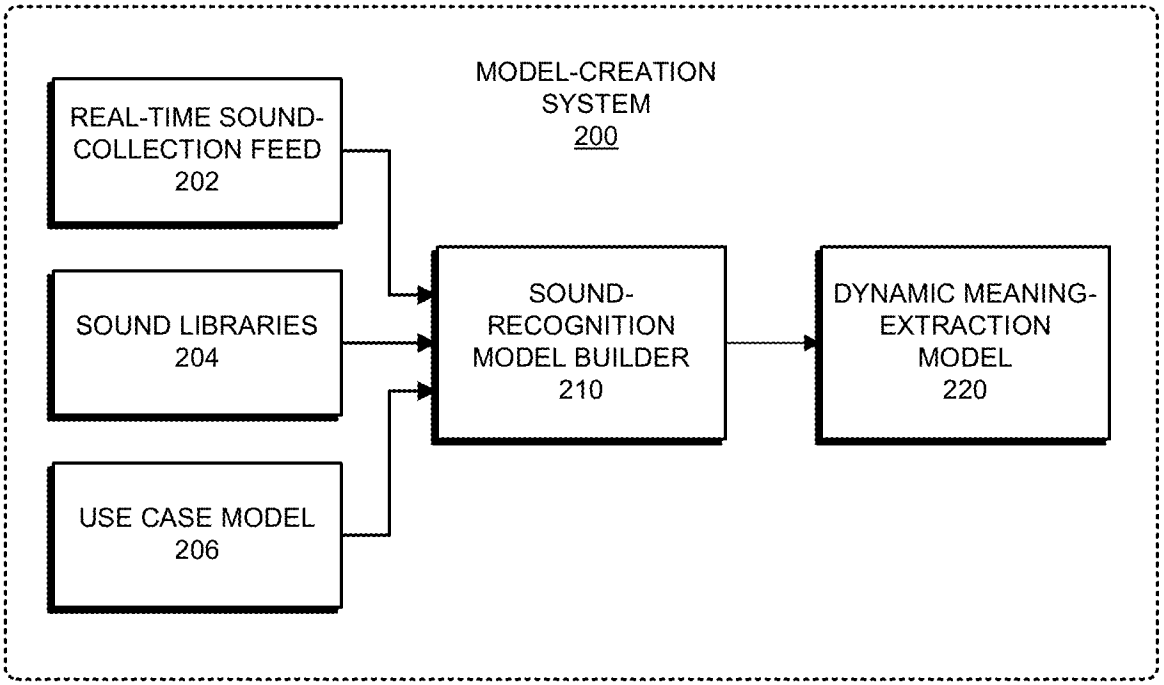
FIG. 2 illustrates a model-creation system in accordance with the disclosed embodiments.

Referring to the model-creation system 200 illustrated in FIG. 2, both local meaning-extraction module 124 and cloud-based meaning-extraction module 132 make use of a dynamic meaning-extraction model 220, which is created by a sound-recognition model builder unit 210. This sound-recognition model builder unit 210 constructs and periodically updates dynamic meaning-extraction model 220 based on audio streams obtained from a real-time sound-collection feed 202 and from one or more sound libraries 204. This model-building and updating process is described in more detail below with reference to FIGS. 3 and 4.

Model-Building Process

Figure 3:
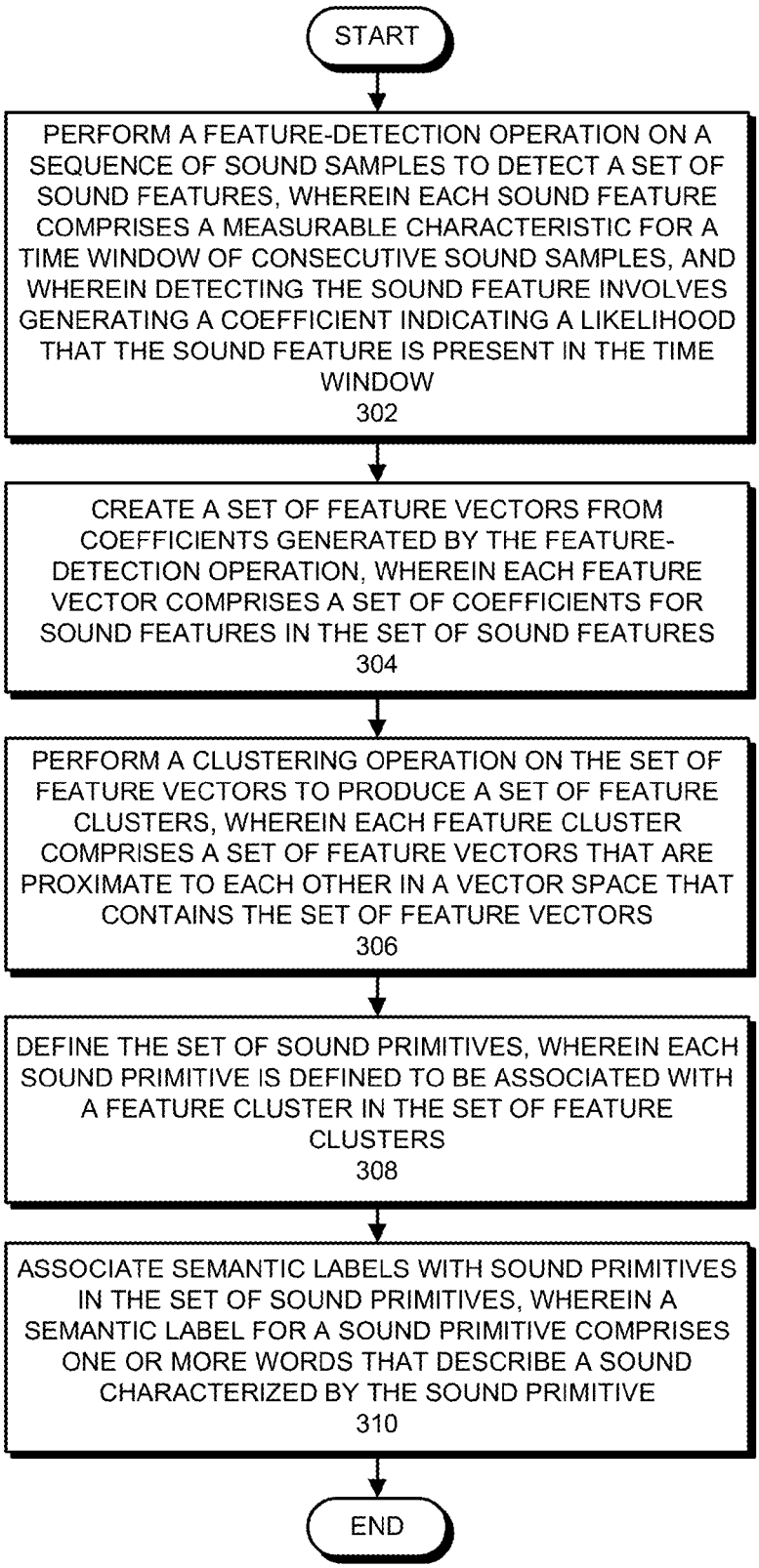
FIG. 3 presents a flow chart illustrating a technique for generating a set of sound primitives through an unsupervised learning process in accordance with the disclosed embodiments.

During the model-building process, the system can use an unsupervised learning technique to generate a model to recognize a set of sound primitives as is illustrated in the flow chart that appears in FIG. 3. First, the system performs a feature-detection operation on a sequence of sound samples to detect a set of predefined sound features, wherein each sound feature comprises a measurable characteristic for a time window of consecutive sound samples, and wherein detecting the sound feature involves generating a coefficient indicating a likelihood that the sound feature is present in the time window (step 302).

For example, a sound feature can comprise a 5-second sliding time window comprising a set of audio samples acquired at 46 millisecond intervals from an audio stream. In general, the set of sound features can include: (1) an average value for a parameter of a sound signal over the time window; (2) a spectral-content-related parameter for a sound signal over the time window; and (3) a shape-related metric for a sound signal over the time window. More specifically, the set of sound features can include: (1) a "pulse" that comprises a peak in intensity of a highest energy component of the sound signal, which can be compared against a delta function, and wherein parameters for the pulse can include a total energy, a duration, and a peak energy; (2) a "shock ratio," which relates to a local variation in amplitude of the sound wave; (3) a "wave-linear length," which measures a total length of the sound wave over the time window; (4) a "spectral composition of a peak" over the time window; (5) a "trajectory of the leading spectrum component" in the sound signal over the time window; for example, the trajectory can be ascending, descending or V-shaped; (6) a "leading spectral component" (or a set of leading spectral components) at each moment in the time window; (7) an "attack strength," which reflects a most brutal variation in sound intensity over the time window; and (8) a "high-peak number," which specifies a number of peaks that are within 80% of the peak amplitude in the time window.

Note that it is advantageous to use a sound feature that can be computed using simple incremental computations instead of more-complicated computational operations. For example, the system can compute the "wave-linear length" instead of the more computationally expensive signal-to-noise ratio (SNR).

Next, the system creates a set of feature vectors from coefficients generated by the feature-detection operation, wherein each feature vector comprises a set of coefficients for sound features in the set of sound features (step 304). The system then performs a clustering operation on the set of feature vectors to produce a set of feature clusters, wherein each feature cluster comprises a set of feature vectors that are proximate to each other in a vector space that contains the set of feature vectors (step 306). This clustering operation can involve any known clustering technique, such as the "k-means clustering technique," which is commonly used in data mining systems. This clustering operation also makes use of a distance metric, such as the "normalized Google distance," to form the clusters of proximate feature vectors.

The system then defines the set of sound primitives, wherein each sound primitive is defined to be associated with a feature cluster in the set of feature clusters (step 308). Finally, the system associates semantic labels with sound primitives in the set of sound primitives, wherein a semantic label for a sound primitive comprises one or more words that describe a sound characterized by the sound primitive (step 310).

Figure 4:
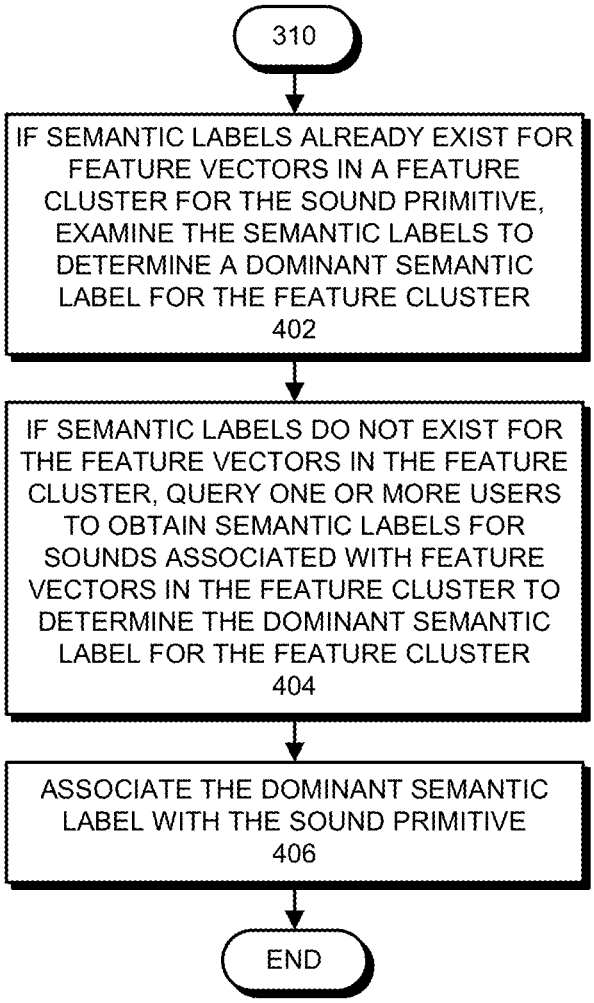
FIG. 4 presents a flow chart illustrating the semantic-labeling process in accordance with the disclosed embodiments.

Referring to the flow chart in FIG. 4, the label-association process of step 310 involves a number of operations. If semantic labels already exist for feature vectors in a feature cluster for the sound primitive, the system examines the semantic labels to determine a dominant semantic label for the feature cluster (step 402). For example, the dominant semantic label can be the most-common semantic label across all of the feature vectors that comprise a feature cluster. On the other hand, if semantic labels do not exist for the feature vectors in the feature cluster, the system can query one or more users to obtain semantic labels for sounds associated with feature vectors in the feature cluster to determine the dominant semantic label for the feature cluster (step 404). Finally, the system associates the dominant semantic label with the sound primitive (step 406).

After the model for recognizing the set of sound primitives has been generated, the system generates a model that recognizes "events" from patterns of lower-level sound primitives. Like sound primitives, events are associated with concepts that have a semantic meaning, and are also associated with corresponding semantic labels. Moreover, each event is associated with a pattern of one or more sound primitives, wherein the pattern for a particular event can include one or more sequences of sound primitives, wherein the sound primitives can potentially overlap in the sequences. For example, an event associated with the concept of "wind" can be associated with sound primitives for "rustling" and "blowing." In another example, an event associated with the concept of "washing dishes" can be associated with a sequence of sound primitives, which include "metal clanging," "glass clinking" and "running water."

Note that the model that recognizes events can be created based on input obtained from a human expert. During this process, the human expert defines each event in terms of a pattern of lower-level sound primitives. Moreover, the human expert can also define higher-level events based on patterns of lower-level events. For example, the higher-level event "storm" can be defined as a combination of the lower-level events "wind," "rain" and "thunder." Instead of (or in addition to) receiving input from a human expert to define events, the system can also use a machine-learning technique to make associations between lower-level events and higher-level events based on feedback from a human expert as is described in more detail below. Once these associations are determined, the system converts the associations into a grammar that is used by a non-deterministic finite-state automaton to recognize events as is described in more detail below.

Note that a sound primitive can be more clearly defined by examining other temporally proximate sound primitives. For example, the sound of an explosion can be more clearly defined as a gunshot if it is followed by more explosions, the sound of people screaming, and the sound of a police siren. In another example, a sound that could be either a laugh or a bark can be more clearly defined as a laugh if it is followed by the sound of people talking.

Sound-Recognition Process

Figure 5:
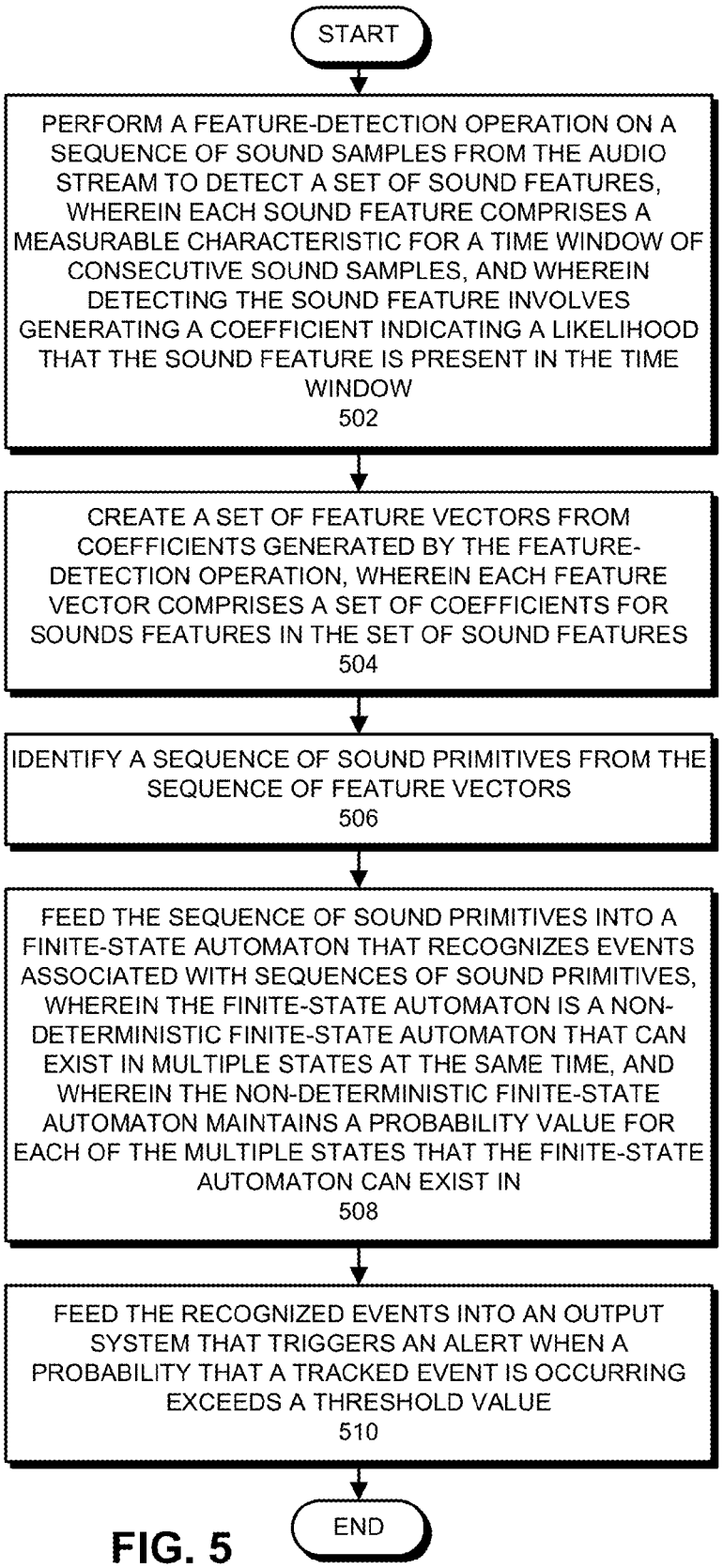
FIG. 5 presents a flow chart illustrating the sound-recognition process in accordance with the disclosed embodiments.

FIG. 5 presents a flow chart illustrating the sound-recognition process that recognizes a sequence of sound primitives in an audio stream in accordance with the disclosed embodiments. During this process, the system performs a feature-detection operation on a sequence of sound samples from the audio stream to detect a set of sound features, wherein each sound feature comprises a measurable characteristic for a time window of consecutive sound samples, and wherein detecting the sound feature involves generating a coefficient indicating a likelihood that the sound feature is present in the time window (step 502). Next, the system creates a set of feature vectors from coefficients generated by the feature-detection operation, wherein each feature vector comprises a set of coefficients for sound features in the set of sound features (step 504). Then, the system identifies the sequence of sound primitives from the sequence of feature vectors (step 506).

Next, the system feeds the sequence of sound primitives into a finite-state automaton that recognizes events associated with sequences of sound primitives. This finite-state automaton can be a non-deterministic finite-state automaton that can exist in multiple states at the same time, wherein the non-deterministic finite-state automaton maintains a probability value for each of the multiple states that the finite-state automaton can exist in (step 508). Finally, the system feeds the recognized events into an output system that triggers an alert when a probability that a tracked event is occurring exceeds a threshold value (step 510).

Figure 6:
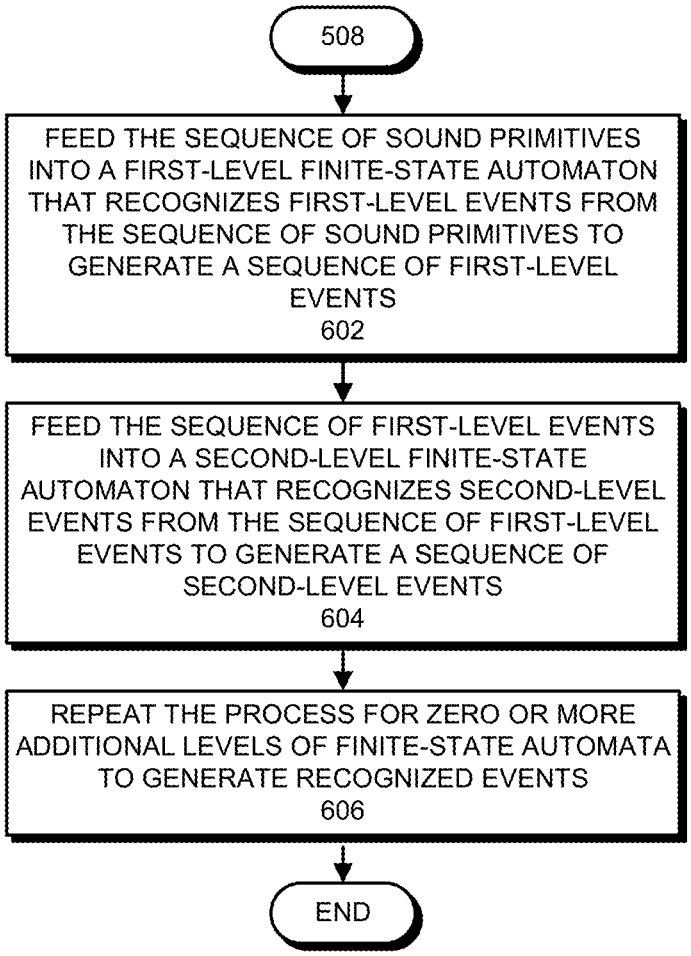
FIG. 6 presents a flow chart illustrating how a multi-level finite-state automaton operates in accordance with the disclosed embodiments.

FIG. 6 presents a flow chart illustrating how the multi-level finite-state automaton (that is described with respect to state 512 above) operates in accordance with the disclosed embodiments. The system first feeds the sequence of sound primitives into a first-level finite-state automaton that recognizes first-level events from the sequence of sound primitives to generate a sequence of first-level events (step 602). Next, the system feeds the sequence of first-level events into a second-level finite-state automaton that recognizes second-level events from the sequence of first-level events to generate a sequence of second-level events (step 604). The system repeats this process for zero or more additional levels of finite-state automata to generate the recognized events (step 606).

EXAMPLE

Figure 7:
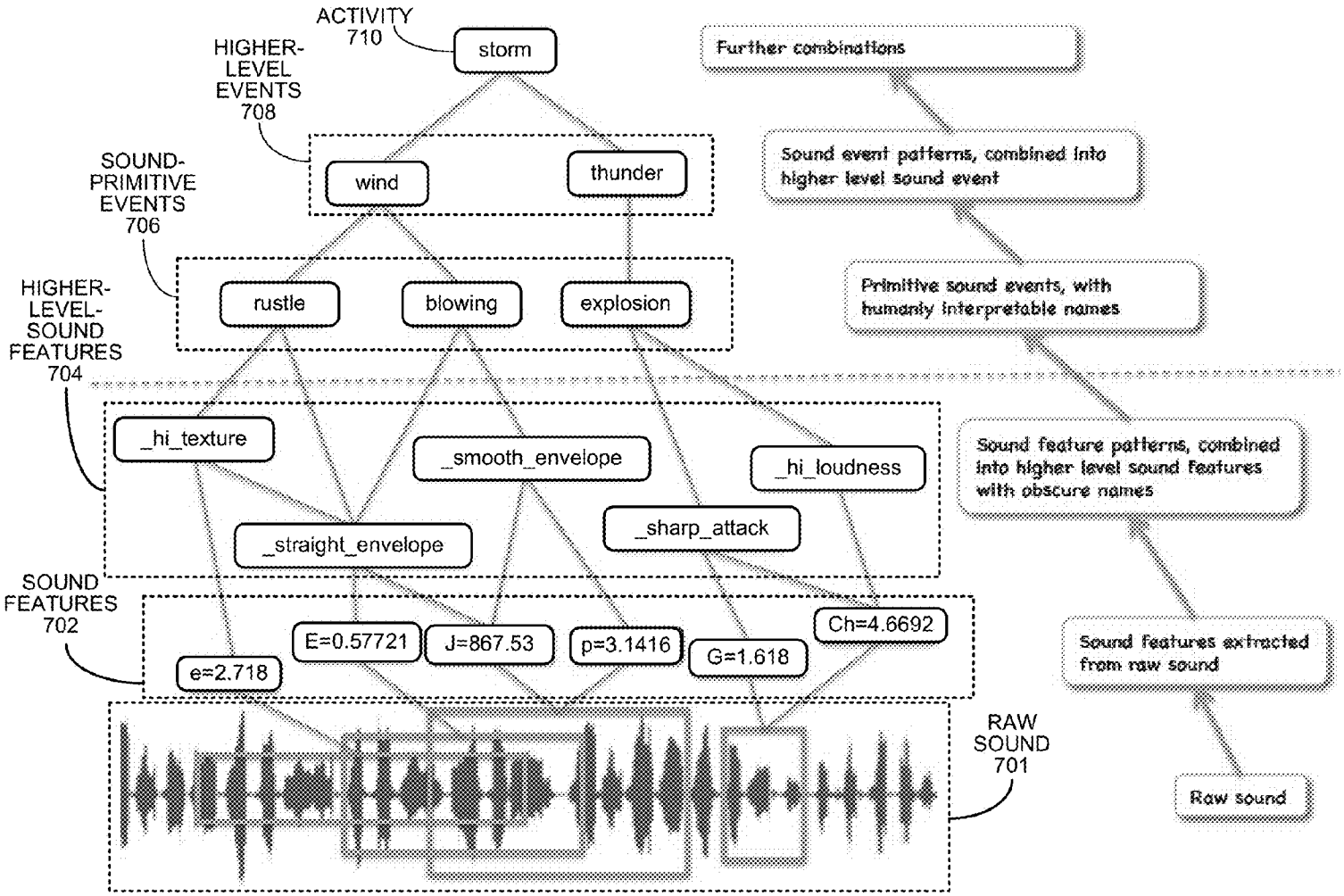
FIG. 7 presents a diagram illustrating an exemplary sound-recognition process in accordance with the disclosed embodiments.

FIG. 7 presents a diagram illustrating an exemplary sound-recognition process in accordance with the disclosed embodiments. The system starts with an audio stream to be recognized comprising raw sound 701. Next, as described above with reference to FIG. 5, the system extracts a set of sound features 702 from the raw sounds 701, wherein each sound feature is associated with a numerical value. The system then combines patterns of sound features into higher-level sound features 704, such as "_smooth_envelope," or "_sharp_attack." These higher-level sound features 704 are then combined into sound-primitive events 706, which are associated with semantic labels, and have a meaning that is understandable to people, such as a "rustling, a "blowing" or an "explosion." Next, these sound-primitive events 706 are combined into higher-level events 708. For example, rustling and blowing sounds can be combined into wind, and an explosion can be correlated with thunder. Finally, the higher-level sound events wind and thunder 708 can be combined into a recognized activity 710, such as a storm.

Non-Deterministic Finite-State Automaton

Figure 8:
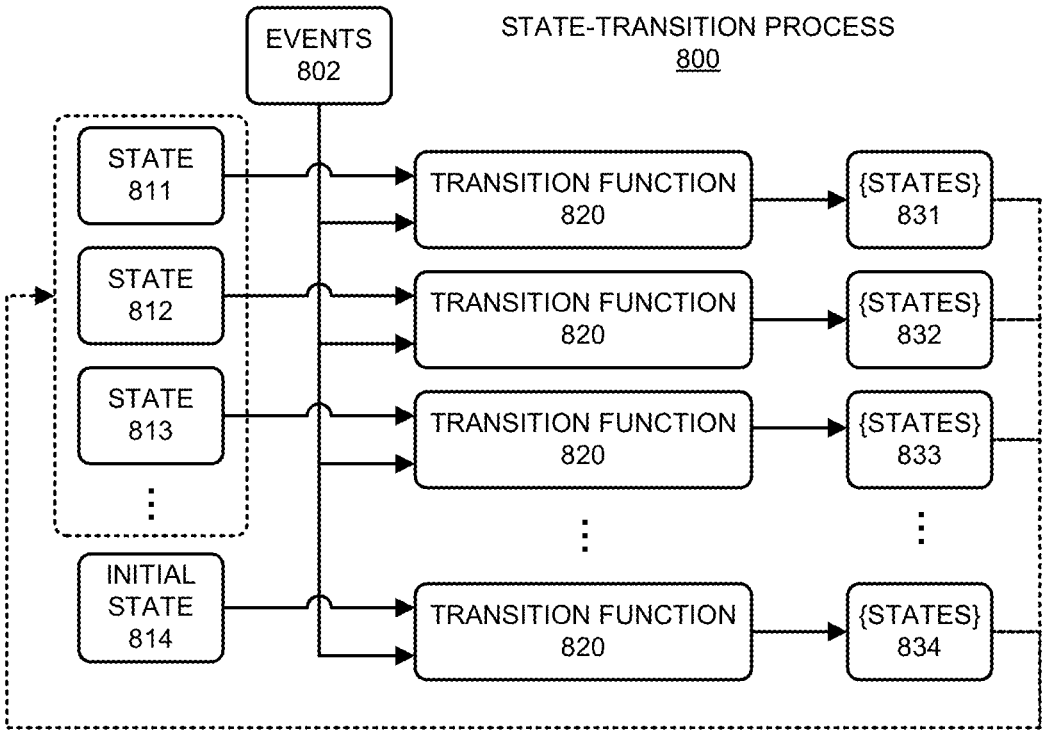
FIG. 8 presents a flow diagram illustrating a state-transition process for a non-deterministic finite-state automaton in accordance with the disclosed embodiments.

As mentioned above, the system can recognize events based on other events (or from sound primitives) through use of a non-deterministic finite-state automaton. An exemplary state-transition process 800 for an exemplary non-deterministic finite-state automaton is illustrated in FIG. 8. As illustrated in FIG. 8, the state-transition process 800 makes use of a transition function 820, which maps a state and a set of events 802 into a set of states. For example, the system can start in an initial state 814, which feeds into transition function 820 along with a set of previously computed events 802 to generate a set of states 834, wherein the set of states 834 can be a vector with a coefficient (from zero to one) for each state. As illustrated in FIG. 8, each state (811, 812, 813, . . . ) in the set of states 834 feeds back around into transfer function 820 to be combined with events 802 to produce another set of states (e.g., sets of state 831, 832, 833, . . . ). Note states with coefficients that fail to reach an "activation potential threshold" value can be pruned by setting the associated state coefficients to zero. This pruning operation helps to prevent an explosion in the number of active states. The above-described state-transition process continually repeats during the sound-recognition process.

Matrix Operations

Figure 9:
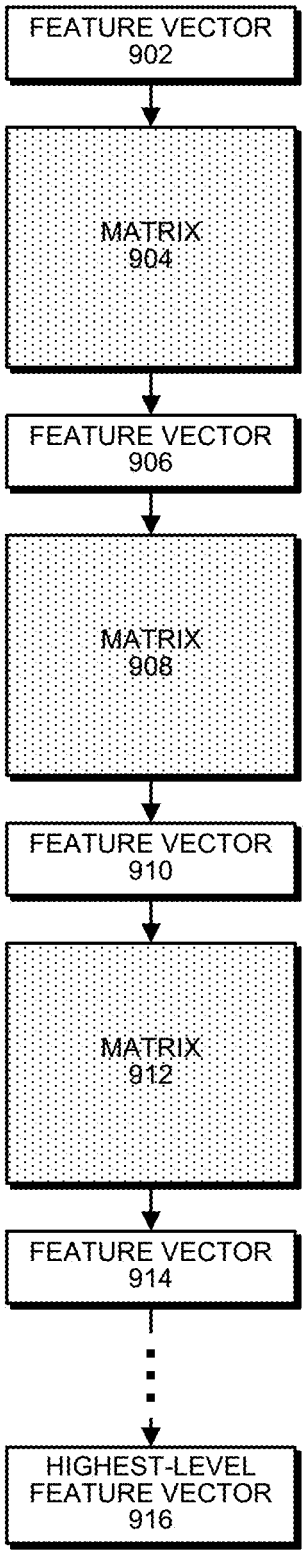
FIG. 9 illustrates a set of matrix operations that are used during the sound-recognition process in accordance with the disclosed embodiments.

FIG. 9 illustrates a set of matrix operations that are used during the sound-recognition process in accordance with the disclosed embodiments. Each of the levels illustrated in FIG. 7 above is associated with a set of features, which are stored in a corresponding feature vector, and these feature vectors 902, 906, 910 and 914 are transformed by intervening matrices 904, 908, and 912 to become higher-level feature vectors. More specifically, feature vector 902 is transformed by matrix 904 to become a higher-level feature vector 906; feature vector 906 is transformed by matrix 908 to become a higher-level feature vector 910; and feature vector 910 is transformed by matrix 912 to become a higher-level feature vector 914. The highest-level feature vector 916 is a result vector, which can be passed on to a client. For example, the lowest-level feature vector 902 can be comprised of sound features, the higher-level feature vector 910 can be comprised of sound primitives, and the highest-level feature vector 916 can be comprised of events. (Note that there can exist additional levels of matrices and feature vectors between feature vector 914 and feature vector 916.)

Figure 10:
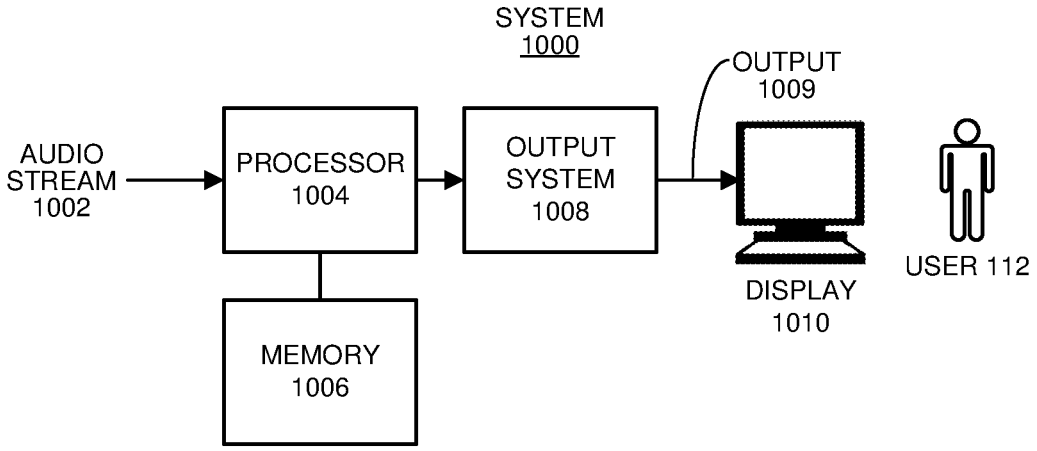
FIG. 10 illustrates the structure of a system that performs a sound-recognition operation in accordance with the disclosed embodiments.

In some embodiments, the system receives feedback from a human who reviews the highest-level feature vector 916 and also listens to the associated audio stream, and then provides feedback about whether the highest-level feature vector 916 is consistent with the audio stream. This feedback can be used to modify the lower-level matrices through a machine-learning process to more accurately produce higher-level feature vectors. Note that this system can use any one of a variety of well-known machine-learning techniques to modify these lower-level matrices. FIG. 10 illustrates the structure of a system 1000 that performs a sound-recognition operation. System 1000 includes a processor 1004 that operates with a memory 1006. During operation, processor 1004 receives an audio stream 1002, and then processes audio stream 1002 to recognize a sequence of sound primitives, which are a fed into a finite-state automata to recognize events associated with the sound primitives. The recognized events are then fed into an output system 1008, which generates an output 1009 that is sent to a display 1010 to be displayed to a user 1012.

Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The foregoing descriptions of embodiments have been presented for purposes of illustration and description only. They are not intended to be exhaustive or to limit the present description to the forms disclosed. Accordingly, many modifications and variations will be apparent to practitioners skilled in the art. Additionally, the above disclosure is not intended to limit the present description. The scope of the present description is defined by the appended claims.

What is claimed is:

1. A method for performing a sound-recognition operation, comprising:

recognizing a sequence of sound primitives in an audio stream, wherein a sound primitive is associated with a semantic label comprising one or more words that describe a sound characterized by the sound primitive, wherein recognizing the sequence of sound primitives comprises, performing a feature-detection operation on a sequence of sound samples from the audio stream to detect a set of sound features, wherein each sound feature comprises a measurable characteristic for a time window of consecutive sound samples, and wherein detecting the sound feature involves generating a coefficient indicating a likelihood that the sound feature is present in the time window, creating a set of feature vectors from coefficients generated by the feature-detection operation, wherein each feature vector comprises a set of coefficients for sound features in the set of sound features, and identifying the sequence of sound primitives from the sequence of feature vectors;

feeding the sequence of sound primitives into a finite-state automaton that recognizes events associated with sequences of sound primitives; and feeding the recognized events into an output system that generates an output associated with the recognized events to be displayed to a user.

2. The method of claim 1, wherein the finite-state automaton is a non-deterministic finite-state automaton that can exist in multiple states at the same time; and wherein the non-deterministic finite-state automaton maintains a probability value for each of the multiple states that the finite-state automaton can exist in.

3. The method of claim 1, wherein feeding the sequence of sound primitives into the finite-state automaton comprises:

feeding the sequence of sound primitives into a first-level finite-state automaton that recognizes first-level events from the sequence of sound primitives to generate a sequence of first-level events;

feeding the sequence of first-level events into a second-level finite-state automaton that recognizes second-level events from the sequence of first-level events to generate a sequence of second-level events; and repeating the process for zero or more additional levels of finite-state automatons to generate the recognized events.

4. The method of claim 3, wherein if a probability value for a state in the non-deterministic finite-state automaton does not meet an activation-potential-related threshold value after a state-transition operation, the probability value for the state is set to zero.

5. The method of claim 3, wherein the finite-state automaton performs state-transition operations by performing computations involving one or more sequence matrices containing coefficients that define state transitions.

6. The method of claim 1, wherein the output system triggers an alert when a probability that a tracked event is occurring exceeds a threshold value.

7. A non-transitory computer-readable storage medium storing instructions that when executed by a computer cause the computer to perform a sound-recognition operation, the method comprising:

recognizing a sequence of sound primitives in an audio stream, wherein a sound primitive is associated with a semantic label comprising one or more words that describe a sound characterized by the sound primitive, wherein recognizing the sequence of sound primitives comprises, performing a feature-detection operation on a sequence of sound samples from the audio stream to detect a set of sound features, wherein each sound feature comprises a measurable characteristic for a time window of consecutive sound samples, and wherein detecting the sound feature involves generating a coefficient indicating a likelihood that the sound feature is present in the time window, creating a set of feature vectors from coefficients generated by the feature-detection operation, wherein each feature vector comprises a set of coefficients for sound features in the set of sound features, and identifying the sequence of sound primitives from the sequence of feature vectors;

feeding the sequence of sound primitives into a finite-state automaton that recognizes events associated with sequences of sound primitives; and feeding the recognized events into an output system that generates an output associated with the recognized events to be displayed to a user.

8. The non-transitory computer-readable storage medium of claim 7, wherein the finite-state automaton is a non-deterministic finite-state automaton that can exist in multiple states at the same time; and wherein the non-deterministic finite-state automaton maintains a probability value for each of the multiple states that the finite-state automaton can exist in.

9. The non-transitory computer-readable storage medium of claim 7, wherein feeding the sequence of sound primitives into the finite-state automaton comprises:

feeding the sequence of sound primitives into a first-level finite-state automaton that recognizes first-level events from the sequence of sound primitives to generate a sequence of first-level events;

feeding the sequence of first-level events into a second-level finite-state automaton that recognizes second-level events from the sequence of first-level events to generate a sequence of second-level events; and repeating the process for zero or more additional levels of finite-state automatons to generate the recognized events.

10. The non-transitory computer-readable storage medium of claim 9, wherein if a probability value for a state in the non-deterministic finite-state automaton does not meet an activation-potential-related threshold value after a state-transition operation, the probability value for the state is set to zero.

11. The non-transitory computer-readable storage medium of claim 9, wherein the finite-state automaton performs state-transition operations by performing computations involving one or more sequence matrices containing coefficients that define state transitions.

12. The non-transitory computer-readable storage medium of claim 7, wherein the output system triggers an alert when a probability that a tracked event is occurring exceeds a threshold value.

13. A system that performs a sound-recognition operation, comprising:

at least one processor and at least one associated memory; and a sound-recognition system that executes on the at least one processor, wherein during operation, the sound-recognition system, recognizes a sequence of sound primitives in an audio stream, wherein a sound primitive is associated with a semantic label comprising one or more words that describe a sound characterized by the sound primitive, wherein while recognizing the sequence of sound primitives, the sound-recognition system, performs a feature-detection operation on a sequence of sound samples from the audio stream to detect a set of sound features, wherein each sound feature comprises a measurable characteristic for a time window of consecutive sound samples, and wherein detecting the sound feature involves generating a coefficient indicating a likelihood that the sound feature is present in the time window, creates a set of feature vectors from coefficients generated by the feature-detection operation, wherein each feature vector comprises a set of coefficients for sound features in the set of sound features, and identifies the sequence of sound primitives from the sequence of feature vectors;

feeds the sequence of sound primitives into a finite-state automaton that recognizes events associated with sequences of sound primitives, and feeds the recognized events into an output system that generates an output associated with the recognized events to be displayed to a user.

14. The system of claim 13, wherein the finite-state automaton is a non-deterministic finite-state automaton that can exist in multiple states at the same time; and wherein the non-deterministic finite-state automaton maintains a probability value for each of the multiple states that the finite-state automaton can exist in.

15. The system of claim 14, wherein if a probability value for a state in the non-deterministic finite-state automaton does not meet an activation-potential-related threshold value after a state-transition operation, the probability value for the state is set to zero.

16. The system of claim 15, wherein the finite-state automaton performs state-transition operations by performing computations involving one or more sequence matrices containing coefficients that define state transitions.

17. The system of claim 13, wherein while feeding the sequence of sound primitives into the finite-state automaton, the sound-recognition system:

feeds the sequence of sound primitives into a first-level finite-state automaton that recognizes first-level events from the sequence of sound primitives to generate a sequence of first-level events;

feeds the sequence of first-level events into a second-level finite-state automaton that recognizes second-level events from the sequence of first-level events to generate a sequence of second-level events; and repeats the process for zero or more additional levels of finite-state automatons to generate the recognized events.

18. The system of claim 13, wherein the output system triggers an alert when a probability that a tracked event is occurring exceeds a threshold value.

* * * * *